US006372088B1

(12) United States Patent
Laivins et al.

(10) Patent No.: US 6,372,088 B1
(45) Date of Patent: Apr. 16, 2002

(54) ENHANCER PERFORMANCE FOR PEO

(75) Inventors: Gunar V. Laivins, Vaudreuil; Marco Polverari, Montreal, both of (CA)

(73) Assignee: Pulp and Paper Reserch Institute of Canada, Pointe Claire (CA)

( * ) Notice: Subject to any disclaimer, the term of this patent is extended or adjusted under 35 U.S.C. 154(b) by 0 days.

(21) Appl. No.: 09/525,552

(22) Filed: Mar. 15, 2000

Related U.S. Application Data

(60) Provisional application No. 60/127,015, filed on Mar. 31, 1999.

(51) Int. Cl.[7] ..... D21H 21/06; D21H 21/10; D21H 17/34

(52) U.S. Cl. ..... 162/168.1; 162/164.1; 162/158; 162/183; 210/728; 210/727; 210/725

(58) Field of Search ..... 162/164.1, 165, 162/168.1, 158, 163; 210/726, 727, 732, 728

(56) References Cited

U.S. PATENT DOCUMENTS

| | | | | | |
|---|---|---|---|---|---|
| 2,357,798 | A | * | 9/1944 | Niederhauser et al. | 524/841 |
| 2,411,557 | A | * | 11/1946 | Schuh | 528/129 |
| 2,785,975 | A | * | 3/1957 | Sheeran | 162/165 |
| 3,062,699 | A | * | 11/1962 | Raphael et al. | 162/135 |
| 3,141,815 | A | * | 7/1964 | Manley | 162/164.3 |
| 3,219,607 | A | * | 11/1965 | Perronin | 524/457 |
| 3,230,198 | A | * | 1/1966 | Meyers | 528/171 |
| 3,281,312 | A | * | 10/1966 | Fetters et al. | 162/168.6 |
| 4,070,236 | A | | 1/1978 | Carrard et al. | |
| 4,313,790 | A | | 2/1982 | Pelton et al. | |
| 5,472,570 | A | * | 12/1995 | Echt | 162/164.1 |
| 5,516,405 | A | | 5/1996 | De Witt | |
| 5,538,596 | A | | 7/1996 | Satterfield et al. | |
| 5,554,260 | A | | 9/1996 | Radu et al. | |
| 5,578,168 | A | * | 11/1996 | Burdick et al. | 162/164.3 |
| 5,595,629 | A | * | 1/1997 | Begala | 162/158 |
| 5,645,731 | A | * | 7/1997 | Burdick et al. | 210/728 |
| 5,670,021 | A | | 9/1997 | Owens | |
| 5,733,414 | A | | 3/1998 | Stockwell | |
| 5,755,930 | A | | 5/1998 | Satterfield et al. | |
| 5,866,669 | A | | 2/1999 | Takatsu et al. | |

FOREIGN PATENT DOCUMENTS

| | | |
|---|---|---|
| WO | WO 97/30222 | 8/1997 |

* cited by examiner

*Primary Examiner*—Jose Fortuna
(74) *Attorney, Agent, or Firm*—Ogilvy Renault

(57) ABSTRACT

A process is disclosed for the production of paper and paper-like products from a suspension of papermaking materials to which poly(ethylene oxide) and a phenolic type cofactor which may be produced by a Williamson synthesis from a resin, are added to improve the retention of fibers, of fines, of dispersed extractives and of fillers during the processes of water removal for the manufacturing of paper.

20 Claims, No Drawings

ENHANCER PERFORMANCE FOR PEO

CROSS-REFERENCE TO RELATED APPLICATION

This Application is related to U.S. application Ser. No. 60/127,015, filed Mar. 31, 1999, and the benefit under 35 U.S.C. 119(e) of such U.S. Application is claimed.

BACKGROUND OF INVENTION

1. Field of Invention

The present invention is directed towards the papermaking process, and, more particularly, to the technical field of wet-end additives to the papermaking furnish. More importantly, the present invention relates to a process for increasing the retention of fines, fillers, and pigments during the manufacture of paper in a mill water system. The invention also provides a novel retention aid system and novel aromatic resin cofactors for such system.

2. Description of Prior Art

In the papermaking process the largest amount of water in a pulp suspension is removed from the fibres, fillers and pigments by filtration. The filtrate, which is commonly called whitewater, contains many fines which may be fibre fragments, mineral fillers, or pigment particles. Poor fines retention is a serious problem because it results in the loss of valuable material to the water system, a possible overloading of the waste water treatment facilities and, in the finished paper sheet, reduced strength properties. To alleviate such problems in the manufacture of fine paper, polymeric flocculants which are called retention aids are commonly added to a suspension of fibres, fines, and fillers prior to the formation of the wet sheet by drainage over a paper machine wire.

Many of the polymers traditionally used for the retention of fillers in fine papermaking are cationic, i.e. they carry a positive charge. Unfortunately mechanical pulp furnishes have high levels of dissolved and colloidal substances, DCS, which are anionic, i.e. negatively charged. It can be anticipated that the DCS preferentially interact with the cationic polymers rendering them less cost-effective in the retention of fines and fillers. Different polymers are needed as retention aids with mechanical pulp furnishes. U.S. Pat. No. 3,141,815, of Nalco Chemical Company, issued Jul. 21, 1964 teaches that poly(ethylene oxide), PEO, can increase the fines retention in certain commercial newsprint furnishes. PEO is nonionic and thus, is less affected by DCS. Furthermore, U.S. Pat. No. 4,070,236 to Carrard and Plummer teaches that PEO is much more effective as a retention aid for mechanical pulp furnishes, upon the addition of water soluble phenolic polymers. Pelton et al., U.S. Pat. No. 4,313,790, teach that other types of polymeric resins such as lignin products derived from kraft pulping processes can also enhance the performance of PEO towards the retention of fines and fillers. The additives which, by themselves do not retain fines, but enhance the retention performance of PEO, are termed cofactors or enhancers and the combination of PEO with a cofactor forms a dual retention aid system.

The practice of mixing a cofactor, i.e. a polymeric phenolic resin, into a furnish prior to the addition of PEO has become widespread and has greatly reduced any variability in the performance of PEO based retention aids. Other benefits of such dual retention aids are that they improve the retention and the cofactors for PEO are relatively inexpensive. More recently, as more mills began to introduce significant amounts of deinked pulp as part of their furnish, the performance of the traditional dual PEO/cofactor retention aids suffered (Tay, S., Tappi J., 80(9):149–156 (1997); Stack, K. R., Dunn, L. A., and Maughan, S., Appita, 48(4): 275–283 (1995)). Other drawbacks of these retention aids are that both phenol formaldehyde resins and lignin products have poor solubility in mill whitewater. Although an evaluation of various phenol formaldehyde resins as enhancers for PEO showed that the higher the molar mass of the resin, the greater the improvement in the retention, such benefits may be lost when using a resin of very high molar mass (molecular weight) due to reduced solubility (Stack, K. R., Dunn, L. A., and Roberts, N. K., J. Wood Chem. Technol., 13(2): 283 (1993)).

It would be advantageous for papermaking to have a cofactor for PEO which can be manufactured to high molar mass while retaining good solubility in mill whitewater systems. U.S. Pat. No. 5,538,596 assigned to Allied Colloids Limited teaches that resins based on a phenol sulphone formaldehyde chemistry may possess such a combination of properties. A possible disadvantage of this combination of polymers for mechanical pulp furnishes is a poor retention of mineral fillers and higher costs for the production of the phenol sulphone formaldehyde resin. Yet another chemistry for a dual retention aid system is disclosed in U.S. Pat. No. 5,554,260, assigned on Sep. 10, 1996 to E.QU.I.P. International, which uses in addition to poly(ethylene oxide), naphthalene sulphonate salts.

U.S. Pat. No. 5,670,021 assigned to Kenura Kemi Aktiebolag teaches that phenolic resins become activated as enhancers for PEO when mixed with soluble alkali metal silicates. However, the introduction of silicates into mill whitewater could lead to problems because silicates form complexes with chemical substances already in the whitewater system. Some silicate containing complexes have poor solubilities and may deposit on papermaking equipment in the form of "stickies".

Recent trends in the manufacture of newsprint or mechanical printing grades of paper are towards a greater use of calcium carbonate fillers to increase opacity, inclusion of deinked pulp in the furnish, greater recirculation of water within a mill and furnishes based on thermomechanical pulp bleached with hydrogen peroxide. Each of these can be expected to significantly modify the chemistry of papermaking. For example, recent investigations on the effects of system closure on newsprint manufacture have found that the concentrations of ionic species build up and that the performance of many traditional retention and drainage aids deteriorate with increasing system closure (Allen, L., Polverari, M., Levesque, B., and Francis, B., in "Coating/Papermakers Conference Proceedings", TAPPI Press, Atlanta, pp. 497–513 (1998)). The combination of high ionic strength and low acidity in a whitewater adversely affects the performance of the traditional PEO plus phenol formaldehyde retention aids because phenol formaldehyde resins precipitate from such whitewater (Stack, K., Dunn, L., and Roberts, N., Colloids and Surfaces A: Physicochemical and Engineering Aspects, 70: 23–31 (1993)).

SUMMARY OF INVENTION

In accordance with one aspect of the invention there is provided in a method of increasing the retention of pulp components and pulp additives in an aqueous papermaking furnish which comprises the pulp components and pulp additives in an aqueous vehicle in which a retention aid is added to the furnish, the improvement wherein the retention aid comprises a poly(oxyethylene) having a molecular weight of at least $10^6$ and an aromatic resin cofactor for said poly(oxyethylene); said aromatic resin cofactor being derived from an aromatic resin which is insoluble or sparingly soluble in said aqueous vehicle and modified to enhance the solubility in the aqueous vehicle.

In accordance with another aspect of the invention there is provided in a method of increasing the retention of pulp components and pulp additives in an aqueous papermaking furnish which comprises the pulp components and pulp additives in an aqueous vehicle in which a retention aid is added to the furnish, the improvement wherein the retention aid comprises a poly(oxyethylene) having a molecular weight of at least $10^6$ and an aromatic resin cofactor for said poly(oxyethylene); said aromatic resin cofactor containing aryloxy groups.

The methods of the invention may be exploited in a process of making paper which comprises: a) forming an aqueous papermaking suspension comprising pulp fibres, fines and papermaking additives in an aqueous vehicle; b) adding a retention aid to the suspension; c) draining the suspension through a screen to form a sheet; and d) drying the sheet; the retention aid being as set forth in the methods of the invention hereinbefore.

In accordance with another aspect of the invention there is provided a retention aid system for use in a papermaking furnish, comprising: a poly(oxyethylene) having a molecular weight of at least $10^6$, and an aromatic resin cofactor for said poly(oxyethylene), said cofactor being derived from an aromatic resin which is insoluble or sparingly soluble in water and modified to enhance the water solubility.

In still another aspect of the invention there is provided a retention aid system for use in a papermaking furnish, comprising: a poly(oxyethylene) having a molecular weight of at least $10^6$, and an aromatic resin cofactor for said poly(oxyethylene), said cofactor containing aryloxy groups.

In accordance with yet another aspect of the invention there is provided an aromatic resin cofactor for the poly (oxyethylene) retention aid in papermaking, said cofactor being derived from an aromatic resin which is insoluble or sparingly soluble in water and modified to enhance the water solubility.

In accordance with still another aspect of the invention there is provided a process for producing an aromatic resin cofactor for a poly(oxyethylene) retention aid in papermaking, said cofactor containing units of aryl alcohol groups of formula:

—Ar—OH wherein Ar is an arylene group selected from unsubstituted or substituted phenylene and naphthylene, comprising reacting an insoluble or sparingly water soluble aromatic resin containing aryl alcohol groups of formula:

—Ar—OH as defined above, with an agent effective to introduce into said resin modifying groups which enhance the water solubility of the modified resin.

In still another aspect of the invention there is provided an aromatic resin cofactor for a poly(oxyethylene) retention aid in papermaking, said cofactor containing units of aryl alcohol groups of formula:

—Ar—OH and aryloxy groups of formula:

—Ar—O— wherein Ar is an arylene group selected from unsubstituted or substituted phenylene and naphthylene, said aryloxy groups comprising 1 to 15 molar %, based on the total of aryl alcohol and aryloxy groups.

In yet another aspect of the invention there is provided a process for producing an aromatic resin cofactor of the invention comprising reacting an aromatic resin containing aryl alcohol groups of formula:

—Ar—OH as defined above, with a compound of formula:

X—R—COOM wherein: R is a straight chain or branched chain alkylene group of 1 to 6 carbon atoms, M is H or a metal ion, and X is a leaving group displaceable by a phenolic hydroxy group, under conditions of a Williamson reaction.

Thus in accordance with the invention a new cofactor for poly(oxyethylene) is provided which improves the retention of fines and mineral fillers in the manufacture of paper products including paper sheet and paperboard.

DETAILED DESCRIPTION OF THE INVENTION

In general a process of making paper comprises forming a papermaking suspension of fibres, fines and fillers, adding a retention aid to the suspension, draining the suspension through a screen to form a sheet, and drying the sheet.

In the process of the invention there is added to the suspension a retention system comprising poly(ethylene oxide) and an aromatic resin cofactor for the poly (oxyethylene), especially a modified phenolic type resin. The modification introduces groups onto the resin which enhance the solubility of the resin and provide a greater tolerance to the presence of electrolytes and acidity in mill whitewater. This dual retention aid system is well suited to a mill whitewater system which has a high conductivity due to high concentrations of ionic species.

In the present invention, the retention of fines and fillers is improved which, in turn, results in decreased fines in the whitewater which then facilities a lower headbox consistency, a higher headbox freeness and a more even distribution of fines and filler in the sheet. A lower consistency of the whitewater system lessens the load on the waste water treatment facilities. A further advantage attendant with the invention is the fixation of dispersed wood resins and colloidal substances in the sheet and this results in fewer problems due to pitch deposition on the paper machine; for example (Pelton, R. H., Allen, L. H., and Nugent, H. M., Pulp Paper Can., 81(1): T9–15, (1980)).

The invention is useful in the production of newsprint, board and mechanical printing grades of paper. The invention can be applied to all furnishes based on mechanical pulp and, optionally, in part, a reinforcement pulp such as semi-bleached kraft or unbleached sulphite pulp. The mechanical pulp may be one or more of the following pulps, alone or in combination; groundwood (GWD), refiner mechanical (RMP), thermomechanical (TMP), chemithermomechanical (CTMP), pressurized groundwood (PGW). Other suitable sources of papermaking materials which can be included as part of the furnish are deinked newsprint and magazines.

Mineral fillers may be present or absent from the furnish. When present they may be brought, inadvertently, as part of the deinked pulp or may be deliberately added as when producing mechanical printing grades of paper. The quantity of filler added to the suspension may typically vary between 2% and 40% by weight, based on oven dry fibres.

Prior to the addition of the retention aids, conventional papermaking additives such as bentonite, cationic starch, alum, coagulants of lower molar mass and resins to develop either dry or wet strength may have been added to the suspension.

The poly(ethylene oxides) used in this invention are commercially available. Best results are obtained when the molar mass (molecular weight) of PEO exceeds one million. Typically the PEO has a molecular weight (weight average) of $10^6$ to $10^{10}$, preferably $10^6$ to $10^8$, and preferably, closer to 10 million with the proviso that the dissolution of the polymer is complete when it is added to the suspension.

The invention describes a new approach to the development of cofactors for PEO. The invention is to modify the chemistry of an aromatic resin, especially a phenolic type resin which is insoluble or sparingly soluble in water of low, moderate or high ionic strength to render it more soluble and increase its tolerance to the ionic composition of mill whitewater. This modification is achieved by incorporating ionic groups or groups that are capable of dissociation as with carboxylic acids or of protonation as with amines at a pH corresponding to that of papermaking.

In general, the modification may be achieved by introduction into the resin of a group bearing an ionic charge, or a non-ionic group capable of dissociation at the pH of the papermaking process, or a non-ionic group capable of protonization at the pH of the papermaking process.

In a particular embodiment the modified aromatic resin cofactor is one containing aryloxy groups which may be formed by modification of aryl alcohol groups in the resin.

Advantageously the solubility of the cofactor should not be so great that the cofactor interacts only with the whitewater while neglecting to interact with poly(ethylene oxide). Although not wishing to be bound to any particular mechanism, the formation of a complex between PEO and the cofactor is thought to play an important role by which the combination of the two polymers improves fibre retention in the papermaking process. However, the formation of such a complex depends on the ability of the cofactor to remain in solution.

The chemistry involved in the preferred embodiment in which aryl alcohol groups are converted to aryloxy groups is a variation of the well known Williamson reaction for the formation of ether compounds from alcohols. (See for example: Morrison, R. T. and Boyd, R. N., in "Organic Chemistry", Chapter 17, pp. 556–8 and Chapter 24 pp. 799–800, 3$^{rd}$ edition, Allyn and Bacon, Inc., Boston (1976), the teachings of which are incorporated herein by reference). These are facile reactions with phenols because they are relatively acidic when compared to aliphatic alcohols. Phenols dissociate to form phenoxide ions in alkaline solutions and since they have dissociation constants of about 10-9, dissociation will range from 5% at pH 8 to 95% at a pH of 10. The phenoxide ion is a particularly good nucleophile and is a reactant in many syntheses. One example of such a synthesis is the preparation of phenoxyacetic acids from chloroacetic acid and phenol. Rather than using a simple phenol the invention applies the chemistry to phenolic type resins. This reaction modifies the resin in a surprisingly advantageous fashion when the modified resin is used in combination with poly(ethylene oxide) as a dual retention aid system for the production of paper and paper-like products.

The aromatic resin produced by the synthesis wherein more than 0 but less than 50%, and preferably less than 20%, of the phenol units are converted to phenoxyacetic acid units is novel and forms a further aspect of the invention. The preferred degree of substitution can vary depending on several factors, including the molecular weight of the resin, the chemical nature of the resin and most importantly the solubility of the resin.

In particular embodiments the modification is carried out using a phenol formaldehyde resin of the resole type, however, the modification reaction can be applied advantageously to any resin having hydroxyl groups attached to aromatic rings. Phenolic resins encompass a wide variety of polymeric substances and each resin may have a multitude of structures, with a variety of raw materials and catalysts used in their preparation. Phenolic resins are prepared by the reaction of a phenol or a substituted phenol with an aldehyde, especially formaldehyde, in the presence of an acidic or basic catalyst. The scope of the reagents used in the manufacture of commercial phenolic resins is given in the Encyclopaedia of Polymer Science and Engineering, Volume 11, pp. 45–95, the teachings of which are incorporated herein by reference. Other suitable resins for the Williamson reaction include natural materials such as lignin and tannins, polyhydroxyl phenols (polyphenols), and resins prepared from naphthol, or its derivatives, with aldehydes. In addition, the aromatic unit of the resin may already possess other substituents, including, for example, sulphonate, carboxylate, nitro or amino groups, along with the hydroxyl groups. As discussed previously, the preferred application is with resins having higher molar mass. The term "higher" is used because such products are formed by condensation reactions and thus have rather complicated structures which can be highly branched or cross-linked. Although the resins are known to those skilled in the art and are commercially available, definite molecular weight data are not readily available for these products.

The same Williamson reaction can be employed to attach groups with different chemical structures onto the resins using a wide variety of chemical reagents. Thus, the modification to a resin is not restricted to that achieved by using chloroacetic acid and similar results are obtained with any of the lower carboxylic acids represented by X—R—(COOM) where X is a leaving group and R is an aliphatic chain, straight or branched, particularly alkylene of 1 to 6 carbon atoms, and M is H or a metal ion especially an alkali metal ion such as sodium. The leaving group X is one displaceable by or that may be substituted by an arylhydroxyl or aryloxy anion such as phenol or phenoxide. Preferred values of X are the halogen atoms. The modification is not, however, restricted solely to halogenated carboxylic acids and salts because an essential feature of the modification is that it changes the solubility of the resin advantageously. Functional groups carrying an ionic charge are widely known to improve the water solubility of resins. An example of a group having a cationic nature is a quaternary ammonium salt while typical anionic groups are phosphates, sulphonic acids and phosphonic acids. Furthermore, non-ionic groups that are capable of dissociation at the pH of papermaking, as in the case of carboxylic acids, or protonization at the pH of papermaking, as with amines, would also render the resin more water soluble.

Preferred resins are phenol formaldehyde resins of the resole type. Preferred reagents for modification of phenol formaldehyde resins by the Williamson reaction include sodium chloroacetate, 2-bromosuccinic acid, 2-chloroethanesulphonic acid, sodium monohydrate, 2-chloroethyltrimethylammonium chloride and 2-chloroethylamine monohydrate. A preferred modification is to incorporate phenoxyacetic acids because they are only partially dissociated at the pH at which many papermaking mills operate. The undissociated units may then participate in hydrogen bonding with the PEO enabling the resin to interact with the PEO flocculant advantageously to form a complex.

In general, the retention rises with an increase in the level of addition of poly(ethylene oxide) and so best results in terms of the retention are obtained when adding relatively high dosages of PEO. However, in the commercial application, because of cost, it is desirable to minimize the dosage of PEO. Furthermore, the gain in the retention obtained by the combination of PEO with the cofactor is larger when the retention gain obtained by PEO without cofactor is small.

In general the dosage of PEO varies between 20 and 2000 g/t of dry pulp; in a preferred embodiment the dosage is within the range from 75 to 500 g/t.

The modified phenolic resin is suitably diluted with distilled water to the desired concentration and then added to the suspension after which comes the addition of PEO. The dosage of modified phenolic resin varies depending principally on the dosage of PEO added. Generally the ratio on dry weight basis of modified resin to PEO is 1 to 10:1, preferably 1 to 6:1 and more preferably 2 to 5:1, and especially 2 to 4:1.

The PEO and resin cofactor can be added to the suspension at the same moment or sequentially. A higher retention is usually obtained by first adding the resin cofactor to the suspension and then adding poly(ethylene oxide). When fillers are deliberately added to the suspension it is possible to premix the filler with some or all of the resin cofactor. Although not limiting in any sense, the poly(ethylene oxide) is preferably added to the papermaking suspension as an aqueous solution as far before the headbox as possible but after all points of extreme turbulence such as the fan pump and pressure screens.

The invention has particular value for applications to furnishes suspended in whitewater having high concentrations of various metal cations and anions and thus possessing high conductivity. The ions may originate from the source of water entering the mill or may come with thick stock pulps which generally are not sufficiently washed to remove the process chemicals. Thick stock pulps rich in process chemicals may be fed into the papermaking system from an on-site deinking plant or from a bleach tower. Furthermore, recent environmental regulations, which are expected to become increasingly stringent, limit the amount of water effluent which a mill may discharge. As a consequence, mills are increasingly recirculating the whitewater, termed "closing up" the water system. Thus, the concentrations of all substances including the ionic species in a whitewater gradually rise or build up. In such a scenario, the invention can be applied usefully to a mill using thick stock pulps free of process chemicals and diluted with water of high conductivity because the mill recycles its whitewater.

Thus in preferred embodiments the invention is concerned with a cofactor for PEO which contains aryloxy groups. Suitable aryloxy groups are of formula:

—Ar—O—R—COOM in which: Ar is an arylene group, typically unsubstituted or substituted phenylene or naphthylene; R is a straight chain or branched chain alkylene of 1 to 6, preferably 1 or 2 carbon atoms; and M is H or a metal ion, especially an alkali metal ion.

In general the cofactor resin is derived from a resin having aryl alcohol groups of formula:

—Ar—OH wherein Ar is as defined above; and the modification employing the Williamson reaction converts some of these aryl alcohol groups to aryloxy groups of formula:

—Ar—O— wherein Ar is as defined above. Typically the modified cofactor resin will contain 1 to 15 molar %, preferably 2 to 8 molar %, more preferably 5 to 7 molar %, of the aryloxy groups based on the total of aryl alcohol and aryloxy groups.

It will be understood that references herein to aryloxy groups excludes arylhydroxyl or aryl alcohol groups, and contemplates ether-type oxy radicals.

The invention is especially concerned with modifying cofactors which are sparingly soluble in the aqueous papermaking systems in which they are employed. Persons in the art will understand what is contemplated sparingly soluble in the context of the invention. Solubility of a cofactor is affected by a number of factors.

For example, the solubility of a cofactor whose chemistry is not altered decreases as the molecular weight becomes progressively larger. Furthermore studies have shown that the nature of the solvent, i.e. pH and ionic composition of the whitewater is also significant. Cofactor precipitation, i.e. insolubility is promoted by low pH and high salt concentration and by salts having cations of higher valency. A useful but rough criterion may be provided by solubility maps, i.e. a plot of pH against the salt concentration giving a boundary between a region of solubility and of precipitation, for the cofactors.

An original or unmodified cofactor may be considered to be sparingly soluble as it precipitated from solution containing calcium nitrate at pH of 5.0 when the calcium ion concentration was only 0.1 mM (4 ppm). Cofactors modified in accordance with the invention, by the introduction of 10% phenoxyacetic acid groups precipitated from calcium nitrate solutions at pH of 5.0 when the calcium ion concentration exceeded 1.0 mM (40 ppm). This chemical modification is deemed to have changed the solubility of the cofactor from sparing to good. However, these numerical figures are simply guidelines and they are expected to be different when other ions are also present and at other pH values and with other cofactor concentrations. It is within the skill of persons in the art to determine an appropriate level of solubility for a cofactor, in a particular papermaking system.

The invention is more especially concerned with modification of aromatic resins as cofactors, which are of high molar mass. In general, but without restriction thereto, aromatic resins of high molar mass may typically have weight average molecular masses ranging from about 500 to about 30,000 g/mol, and more typically about 20,000 to about 26,000 g/mol.

EXAMPLES

In order to disclose more clearly the nature of the invention the following examples illustrating the invention are given.

In each of the following Examples a Dynamic Drainage Jar was used for measurement of the retention. Operating conditions to avoid the formation of a mat during the test and a complete description of the apparatus are given in Pulp Paper Can., 80(12):T425 (1979).

Polymer Preparation

Poly(ethylene oxide), Floc 999, (Trade-mark) with a nominal molar mass of 6 to 9 million was obtained from E.QU.I.P. International. Some care was taken to ensure a uniform make down procedure. Daily, a stock solution was prepared by dispersing 0.2 g of the powder in 2 mL of ethanol in a flask. This was then made up to 100 mL by adding distilled water. To ensure complete dissolution, the flask was mechanically shaken for ninety minutes. A further dilution (6 to 60 mL) was carried out thus giving the polymeric solution which was added to a pulp suspension. This latter solution was replenished every 2 hours because PEO loses efficiency as a retention aid during storage.

All commercial cofactors were provided by E.QU.I.P. International, with the exception of PSR which was obtained from Allied Colloids International. The solids content of each cofactor solution was obtained by a freeze-drying procedure (Allen, L, Polverari, M, Levesque, B, and Francis, B, in "Coating/Papermakers Conference Proceedings", TAPPI Press, Atlanta, pp. 497–513 (1998)). Solutions of the cofactors were prepared by diluting 1 g of each solution to 100 mL with water. This solution was further diluted by a factor of 10 before use in retention trials.

Retention Measurements 500 mL of headbox stock were heated to 60° C. in a beaker. The pH was set to 5.2 by adding drops of HCl or NaOH as needed. Next, an aliquot of a cofactor solution was added to the stirred suspension. After thirty seconds, the suspension was poured into the DDJ which was fitted with a perforated stainless steel plate, mesh size 40, and the propeller was operated at 750 rpm. The suspension was stirred for 15 seconds prior to the addition of an aliquot of PEO giving a dosage of 75 g/t of dry pulp. The contact time between PEO addition and drainage was 15 seconds. The first 50 mL of effluent were discarded. The next 100 mL were collected and then drained through a preweighed filter paper. The ashless filter paper and contents were dried and reweighed. The dry weight of the solids of each whitewater sample was calculated from the difference in weights of the filter paper. Finally the paper and contents were ashed in preweighed crucibles for 4 h in an oven at 625° C. The amount of clay in the sample was obtained from the difference in weights.

FPR values were calculated according to Equation 1, where $C_s$ is the consistency of the stock suspension poured into the DDJ and $C_{ww}$ is the consistency of the whitewater drained from the DDJ.

$$FPR=(C_s-C_{ww})\times 100/C_s \quad [1]$$

First pass ash retention (FPAR) values were calculated for trials in which the stocks contained clay fillers. Equation 1 was modified slightly to redefine $C_s$ and $C_{ww}$ as the consistencies of clay fillers in the stock suspension and in the whitewater drained from the DDJ, respectively. The values reported are the averages of at least two trials.

In the following Examples, the reference to percentage of phenoxyacetic acid or the like modifying units in phenol formaldehyde resin refers to the molar % of such units based on the total molar amount of phenol units and phenoxyacetic acid units, or the like, in the cofactor.

Example 1

For this experiment, the furnish was obtained from an integrated newsprint mill. The mill manufactures newsprint using a furnish consisting of 90% hydrosulphite bleached thermomechanical pulp and 10% deinked pulp. During bleaching at the mill, a hydrosulphite dosage of 1.8 kg/tonne of pulp was applied to the TMP to obtain a final brightness of 67–68%. The pulp was stored in 20 L polyethylene containers at 5° C. The stock was stirred at room temperature for 2 to 3 hours prior to use in retention testing.

The results compare the performances of a series of cofactors prepared from a standard phenolic formaldehyde resin, BB143, produced by NESTE RESINS. The resin was modified by a Williamson reaction so as to progressively introduce phenoxyacetic acid units onto the resin. Control experiments were carried out without addition of a polymeric retention aid and then using PEO alone. For this comparison, the ratio of cofactor to PEO was maintained at 2:1 and the dosage of PEO was 75 grams per tonne of oven dry pulp. All polymer dosages were based on net solids. The data show that the efficiency of the PEO retention aids was greatly enhanced by using a cofactor which had been modified so as to introduce phenoxyacetic acid units onto the resin.

| Percentage of phenoxyacetic acid units in phenol formaldehyde resin | Retention of fines and filler, FPR, (%) | Retention of filler, FPAR, (%) |
|---|---|---|
| no retention polymers | 39.8 | 2.2 |
| PEO without a cofactor | 43.9 | 9.3 |
| original resin (as received) | 46.6 | 11.9 |
| 2.5 | 63.7 | 45.9 |
| 5.0 | 63.0 | 45.6 |
| 7.5 | 60.8 | 42.7 |
| 10 | 56.9 | 32.0 |
| 15 | 45.2 | 12.7 |
| 25 | 45.40 | 12.9 |
| 50 | 44.1 | 8.2 |

Example 2

This example illustrates the effect of the dosage of the cofactors on the retention of fines and fillers while maintaining the dosage of PEO at 75 g/t of oven dried pulp. Included in the comparison are the unmodified BB143 cofactor, the modified cofactor having 5% of phenoxyacetic acid units and a more expensive polysulphone resin, PSR. The pulp and experimental method were as described in Example 1. When retention tests were carried out without the addition of any polymeric retention aid, the FPR and FPAR values obtained were 41.9% and 2.0% respectively. The results show that the cofactor produced by a Williamson reaction from a phenol formaldehyde resin and chloroacetic acid enhances the performance of PEO when using low dosages of the modified cofactor.

| Cofactor Dosage, g/t (based on oven-dried pulp) | | | First Pass Retention (%) | |
|---|---|---|---|---|
| BB143 | 5% modified | PSR | FPR | FPAR |
| 0 | 0 | 0 | 48.7 | 15.5 |
| 75 | 0 | 0 | 46.8 | 12.1 |
| 150 | 0 | 0 | 48.8 | 16.5 |
| 300 | 0 | 0 | 58.4 | 29.9 |
| 0 | 75 | 0 | 66.9 | 47.5 |
| 0 | 150 | 0 | 72.1 | 57.8 |
| 0 | 300 | 0 | 70.9 | 56.4 |

-continued

| Cofactor Dosage, g/t (based on oven-dried pulp) | | | First Pass Retention (%) | |
|---|---|---|---|---|
| BB143 | 5% modified | PSR | FPR | FPAR |
| 0 | 0 | 75 | 62.9 | 42.2 |
| 0 | 0 | 150 | 68.7 | 51.0 |
| 0 | 0 | 300 | 71.2 | 56.2 |

Example 3

The combination of PEO (Floc 999) and the modified cofactor having 5% of phenoxyacetic acid was evaluated as a fines retention aid using the furnish and procedure described in Example 1. The results show that the furnish is responsive to poly(ethylene oxide) when used without a cofactor; the fines retention progressively rises with PEO dosage. The addition of the cofactor then gives a further gain in the fines retention, no matter what the dosage level of the poly(ethylene oxide), thus demonstrating the synergistic effect obtained by using the cofactor.

| POLYMER DOSAGE, g/t (based on oven-dried pulp) | | FIRST PASS RETENTION |
|---|---|---|
| Floc 999 | 5% modified | (%) |
| 0 | 0 | 46.5 |
| 75 | 0 | 51.7 |
| 75 | 150 | 63.2 |
| 150 | 0 | 61 |
| 150 | 300 | 78.3 |
| 225 | 0 | 71.6 |
| 225 | 450 | 86.6 |
| 300 | 0 | 75.4 |
| 300 | 600 | 91.0 |

Example 4

Illustrated in this example is the effect of the calcium ion of a whitewater on the retention of fines and fillers. The experimental method were as described in Example 1. However, for some of the testing, we added calcium nitrate salt (Fisher Scientific) to the furnish to raise the concentration of the calcium ion in the whitewater; cation contents were determined by inductively coupled plasma emission spectroscopy. When retention tests were carried out without the addition of any polymeric retention aid, the FPR and FPAR values obtained were 39.8% and 2.2% respectively. For this set of tests, the dosages of the cofactors and of PEO were maintained at 150 g/t and 75 g/t, respectively, of oven dried pulp and one test was PEO alone, without any cofactor. Included in the comparison are the unmodified BB143 cofactor and the modified cofactor having 5% of phenoxyacetic acid units. The results show that the cofactor produced by a Williamson reaction from a phenol formaldehyde resin and chloroacetic acid enhances the performance of PEO when applied to a furnish whose whitewater is rich in calcium ions.

| Calcium ion concentration | Cofactor Dosage, g/t (based on oven-dried pulp) | | First Pass Retention (%) | |
|---|---|---|---|---|
| mg/L | BB143 | 5% modified | FPR | FPAR |
| 33.1 | 0 | 0 | 44.3 | 10.2 |
| 72.4 | 0 | 0 | 45.3 | 11.4 |
| 110 | 0 | 0 | 45.2 | 11.2 |
| 148 | 0 | 0 | 47.0 | 12.7 |
| 35.4 | 140 | 0 | 47.4 | — |
| 165 | 140 | 0 | 47.0 | — |
| 33.1 | 0 | 150 | 64.7 | 46.8 |
| 72.4 | 0 | 150 | 64.8 | 47.0 |
| 110 | 0 | 150 | 64.7 | 46.1 |
| 148 | 0 | 150 | 62.7 | 44.5 |

Example 5

For this experiment, the furnish was obtained from an integrated newsprint mill which has a deinking facility on site. The deinked pulp is made from newspaper and old magazines in a ratio of 3:1. The deinking process is carried out in two stages; first under alkaline conditions and then the pulp is washed and cleaned in acidified water. The mill manufactures newsprint using a furnish consisting of 70.6% hydrosulphite bleached thermomechanical pulp and 29.4% deinked pulp. The pulp was stored in 20 L polyethylene containers at 5° C. The stock was stirred at room temperature for 2 to 3 hours prior to use in retention testing.

The results compare the performances of a series of cofactors prepared from a standard phenolic formaldehyde resin, BB143, produced by NESTE RESINS. The resin was modified by a Williamson reaction so as to progressively introduce phenoxyacetic acid units onto the resin. Control experiments were carried out without addition of a polymeric retention aid and then using PEO alone. For this comparison, the ratio of cofactor to PEO was maintained at 2:1 and the dosage of PEO was 75 grams per tonne of oven dry pulp. All polymer dosages were based on net solids. The results show that the unmodified cofactor does not appreciably enhance the performance of PEO in the retention of fines and fillers. However, the introduction of phenoxyacetic acid units onto the resin and then using the modified resin as a cofactor greatly enhances the efficiency of PEO towards the retention of fines and fillers.

| Percentage of phenoxyacetic acid units in phenol formaldehyde resin | Retention of fines and filler, FPR, (%) | Retention of filler, FPAR, (%) |
|---|---|---|
| no retention polymers | 51.4 | 7.6 |
| PEO without a cofactor | 58.5 | 26.9 |
| original resin (as received) | 59.8 | 28.7 |
| 2.5 | 67.8 | 45.6 |
| 5.0 | 68.1 | 47.7 |
| 7.5 | 66.0 | 44.3 |
| 10 | 65.1 | 42.9 |

Example 6

The furnish used in this example was used to produce a supercalendered grade of paper and it consisted of 61% hydrogen peroxide bleached TMP, 4% hydrosulphite TMP, 6% kraft and 29% clay fillers. This latter furnish had a brightness of greater than 70%. The fresh water usage at the mill was 55 $m^3$/t, typical of an older facility. The pulp was stored in 20 L polyethylene containers at 5° C. the stock was stirred at room temperature for 2 to 3 hours prior to use in retention testing.

Simulated whitewater for an advanced closure level was prepared in the laboratory by washing thermomechanical pulp which had been previously bleached using hydrogen peroxide in a pilot plant. The apparatus for whitewater preparation consisted of a stock tank, screw press, whitewater tank and pumps (Francis, D. W. and Ouchi, M. D., in "Proceedings of wet end chemistry and COST workshop", Pira International, Leatherhead, Paper 21 (1997)). It was operated in batch mode. The unwashed pulp at 30% consistency was diluted to 2% consistency with fresh water and was agitated for 30 minutes at 60° C. The pulp suspension was then dewatered to 44% consistency with the screw press and the pressate was recycled to diluted the next batch of pulp. This cycle was repeated for 25 batches until the desired contaminant level was attained. A small quantity of fresh water was added after batch 10 to produce the desired volume of whitewater. Gravity clarification was used to remove the suspended solids. The simulated whitewater corresponded to that of a fully integrated mill using a fresh water addition of about 3 $m^3$/t. The whitewater from the headbox stock was removed by filtration and then the pulp was redispersed in the whitewater simulating an advanced closure level.

The results compare the performances of a series of cofactors prepared from a standard phenolic formaldehyde resin, BB143, produced by NESTE RESINS. The resin was modified by a Williamson reaction so as to progressively introduce phenoxyacetic acid units onto the resin. Control experiments were carried out without addition of a polymeric retention aid and then using PEO alone. For this comparison, the ratio of cofactor to PEO was maintained at 2:1 and the dosage of PEO was 75 grams per tonne of oven dry pulp. All polymer dosages were based on net solids. The results show that the cofactors produced by a Williamson reaction from a phenol formaldehyde resin and chloroacetic acid enhance the performance of PEO towards the retention of fines and fillers.

| Percentage of phenoxyacetic acid units in phenol formaldehyde resin | Retention of fines and filler, FPR, (%) | | Retention of filler, FPAR, (%) | |
|---|---|---|---|---|
| | 55 $m^3$/t | 3 $m^3$/t | 55 $m^3$/t | 3 $m^3$/t |
| no retention polymers | 29.4 | 27.7 | 3.3 | 2.0 |
| PEO without a cofactor | 49.2 | 41.2 | 33.0 | 23.0 |
| original resin (as received) | 46.0 | 41.0 | 29.3 | 23.1 |
| 2.5 | 57.4 | 46.1 | 44.9 | 30.2 |
| 5.0 | 57.4 | 48.8 | 44.4 | 33.2 |
| 7.5 | 56.0 | 49.9 | 42.6 | 34.9 |

Example 7

Illustrated in this example is the reduction of dispersed resin concentration brought about by the combination of PEO with the modified cofactor having 5% of phenoxyacetic acid units. These experiments were carried out using a headbox stock consisting of 85% hydrosulphite bleached thermomechanical pulp and 15% deinked pulp. The concentration of colloidally dispersed wood resin in the DDJ was determined by the method of Allen L. H., Pulp and Paper Canada 78, TR 32, (1977). In this procedure the resin particle concentrations were determined with a hemacytometer and microscope which was fitted with a 40× objective lens and gave an overall magnification of 800×. The results are shown as a function of the concentrations of the two polymers and at the highest polymer concentrations the dispersed resin concentration was reduced by 83%. Clearly the poly(ethylene oxide) (Floc 999) was effective in removing resin on its own, however, its effectiveness was increased by the addition of the modified BB143 cofactor having 5% of phenoxyacetic acid units.

| POLYMER DOSAGE, g/t (based on oven-dried pulp) | | First Pass Retention | Resin Particle Concentration (particles | Percentage |
|---|---|---|---|---|
| Floc 999 | 5% modified | % | per $cm^3$ (× $10^{-6}$)) | Reduction |
| 0 | 0 | 42.9 | 35.2 | — |
| 75 | 0 | 47.7 | 14.8 | 58.0 |
| 75 | 75 | 61.4 | 10.4 | 70.4 |
| 75 | 150 | 69.0 | 8.6 | 75.6 |
| 75 | 300 | 74.3 | 6.0 | 83.0 |

Example 8

The results compare the performances of a series of cofactors prepared from a phenolic formaldehyde resin, Cascophen PR-511 (Trade-mark), produced by Borden Chemicals. As described in the technical bulletin, the resin is a liquid phenol formaldehyde resin designed for use in applications where saturation by the resin is desired. The resin was modified by a Williamson reaction so as to progressively introduce phenoxyacetic acid units onto the resin. Control experiments were carried out without addition of a polymeric retention aid and then using PEO alone. For this comparison, the ratio of cofactor to PEO was maintained at 2:1 and the dosage of PEO was 75 grams per tonne of oven dry pulp. All polymer dosages were based on net solids. The furnish was described in Example 5. The data show that the efficiency of the PEO retention aids were slightly enhanced by using a cofactor which had been modified so as to introduce phenoxyacetic acid units onto the resin. Clearly, the enhancement brought about by modification of Cascophen PR-511 resin was comparable to that achieved when the BB143 resin was modified so as to introduce phenoxyacetic acid units (see Example 5).

| Percentage of phenoxyacetic acid units in phenol formaldehyde resin | Retention of fines and filler, FPR, (%) | Retention of filler, FPAR, (%) |
|---|---|---|
| no retention polymers | 52.0 | 5.2 |
| PEO without a cofactor | 60.9 | 28.1 |
| original resin (as received) | 61.9 | 29.8 |
| 2.5 | 67.2 | 41.4 |
| 5.0 | 69.9 | 48.7 |
| 7.5 | 71.5 | 52.4 |
| 10 | 71.1 | 52.1 |
| 15 | 66.6 | 43.8 |

Example 9

For this example, a set of cofactors was produced by a Williamson type reaction using a standard phenol formaldehyde resin, BB143, and 2-chloroethane sulfonic acid, sodium monohydrate. Thus, this reaction modifies the resin by incorporating phenoxyethyl sulfonic acids onto the original resin. The experimental method was as described in Example 1 using a headstock pulp consisting of 80% hydrosulphite bleached thermomechanical pulp and 20% deinked pulp. Control experiments were carried out without addition of a polymeric retention aid and then using only PEO at a dosage of 75 grams per tonne of oven dry pulp. For this comparison, the ratio of cofactor to PEO was maintained at 2:1. The results show that the cofactors produced by a Williamson reaction from a phenol formaldehyde resin and 2-chloroethane sulfonic acid, sodium monohydrate enhance the performance of PEO towards the retention of fines and fillers. Clearly, the enhancement is not as great as that obtained when the same phenol formaldehyde resin was modified so as to introduce phenoxyacetic acid units.

| Percentage of modified units in phenol formaldehyde resin | Retention of fines and filler, FPR, (%) | Retention of filler, FPAR, (%) |
|---|---|---|
| no retention polymers | 43.0 | 4.4 |
| PEO without a cofactor | 51.1 | 23.2 |
| original resin (as received) | 50.5 | 19.5 |
| 2.5 | 56.2 | 30.1 |
| 5.0 | 55.4 | 28.5 |
| 7.5 | 56.0 | 29.3 |
| 10 | 51.8 | 22.5 |

We claim:

1. A process of making paper comprising:

a) forming an aqueous papermaking suspension comprising pulp fibres, fines and papermaking additives in an aqueous vehicle;

b) adding a retention aid to the suspension, c) draining the suspension through a screen to form a sheet; and d) drying the sheet;

said retention aid comprising a poly(oxyethylene) having a molecular weight of at least $10^6$ and an aromatic resin cofactor for said poly(oxyethylene); said aromatic resin cofactor being derived from an aromatic resin having aryl alcohol groups of formula:

—Ar—OH and aryloxy groups of formula:

—Ar—O— wherein

Ar is an arylene group selected from unsubstituted or substituted phenylene and naphthylene; said aryloxy groups comprising 1 to 15 molar %, based on the total of aryl alcohol and aryloxy groups, which is insoluble or sparingly soluble in said aqueous vehicle and modified to enhance the solubility in the aqueous vehicle.

2. A process according to claim 1, wherein said aqueous vehicle is of moderate or high ionic strength and the modification of the aromatic resin renders it soluble in the aqueous vehicle and increases the tolerance of the resin to the ionic composition of a paper mill whitewater.

3. A process according to claim 1, wherein the aromatic resin is modified by the introduction of a group selected from a group bearing an ionic charge, a non-ionic group capable of dissociation at the pH of the paper making process or a non-ionic group capable of protonization at the pH of the paper making process.

4. A process according to claim 1, wherein said aryloxy group is of formula —Ar—O—R—COOM wherein:

Ar is an arylene group;

R is a straight chain or branched chain alkylene of 1 to 6 carbon atoms; and M is hydrogen or a metal ion.

5. A process according to claim 4, wherein Ar is unsubstituted or substituted phenylene, R is alkylene of 1 or 2 carbon atoms and M is H or an alkali metal ion.

6. A process of making paper comprising:

a) forming an aqueous papermaking suspension comprising pulp fibres, fines and papermaking additives in an aqueous vehicle;

b) adding a retention aid to the suspension, c) draining the suspension through a screen to form a sheet; and d) drying the sheet;

said retention aid comprising a poly(oxyethylene) having a molecular weight of at least $10^6$ and an aromatic resin cofactor for said poly(oxyethylene); said aromatic resin cofactor being derived from an aromatic resin having aryl alcohol groups of formula:

—Ar—OH and aryloxy groups of formula:

—Ar—O— wherein

Ar is an arylene group selected from unsubstituted or substituted phenylene and naphthylene; said aryloxy groups comprising 1 to 15 molar %, based on the total of aryl alcohol and aryloxy groups.

7. A process according to claim 6, wherein said poly (oxyethylene) has a molecular weight of $10^6$ to $10^8$.

8. A process according to claim 7, wherein said poly (oxyethylene) is added to the suspension in an amount of 20 to 2000 g/t of dry pulp in said suspension and said cofactor is added to the suspension in a dry weight basis ratio of cofactor to poly(oxyethylene) of 1 to 6:1.

9. A process according to claim 8, wherein said amount of poly(oxyethylene) is 75 to 500 g/t of dry pulp in said suspension.

10. A process according to claim 9, wherein said ratio is 2 to 5:1.

11. A process according to claim 6, wherein said aryloxy groups are ionic groups effective to render the resin cofactor soluble in the aqueous vehicle.

12. A process according to claim 6, wherein said aryloxy groups are non-ionic groups which dissociate or protonate in said aqueous vehicle and render the resin cofactor soluble in said aqueous vehicle.

13. A process according to claim 6, wherein said aryloxy groups are of formula —Ar—O—R—COOM wherein:

Ar is an arylene group;

R is a straight chain or branched chain alkylene of 1 to 6 carbon atoms; and

M is hydrogen or a metal ion.

14. A process according to claim 13, wherein Ar is unsubstituted or substituted phenylene, R is alkylene of 1 or 2 carbon atoms and M is H or an alkali metal ion.

15. A process according to claim 6, wherein said resin cofactor is derived from a phenol formaldehyde resin.

16. A process according to claim 6, wherein said pulp fibres comprise mechanical pulp fibres.

17. In a method of increasing the retention of pulp components and pulp additives in an aqueous papermaking furnish which comprises the pulp components and pulp additives in an aqueous vehicle in which a retention aid is added to the furnish, the improvement comprising adding a retention aid to said furnish, which comprises a poly (oxyethylene) having a molecular weight of at least $10^6$ and an aromatic resin cofactor for said poly(oxyethylene); said aromatic resin cofactor being derived from an aromatic resin having aryl alcohol groups of formula:

—Ar—OH and aryloxy groups of formula:

—Ar—O— wherein

Ar is an arylene group selected from unsubstituted or substituted phenylene and naphthylene; said aryloxy groups comprising 1 to 15 molar %, based on the total of aryl alcohol and aryloxy groups, which is insoluble or sparingly soluble in said aqueous vehicle and modified to enhance the solubility in the aqueous vehicle.

18. A method according to claim 17, wherein said poly (oxyethylene) has a molecular weight of $10^6$ to $10^8$; said poly(oxyethylene) is added in an amount of 75 to 500 g/t of dry pulp components; and said cofactor is added in a dry weight basis ratio of cofactor to poly(oxyethylene) of 2 to 5:1.

19. In a method of increasing the retention of pulp components and pulp additives in an aqueous papermaking furnish which comprises the pulp components and pulp additives in an aqueous vehicle in which a retention aid is added to the furnish, the improvement comprising adding a retention aid to the furnish, which comprises a poly (oxyethylene) having a molecular weight of at least $10^6$ and an aromatic resin cofactor for said poly(oxyethylene); said aromatic resin cofactor being derived from an aromatic resin having aryl alcohol groups of formula:

—Ar—OH and aryloxy groups of formula:

—Ar—O— wherein

Ar is an arylene group selected from unsubstituted or substituted phenylene and naphthylene; said aryloxy groups comprising 1 to 15 molar %, based on the total of aryl alcohol and aryloxy groups.

20. A method according to claim 19, wherein said poly (oxyethylene) has a molecular weight of $10^6$ to $10^8$; said poly(oxyethylene) is added in an amount of 75 to 500 g/t of dry pulp components; and said cofactor is added in a dry weight basis ratio of cofactor to poly(oxyethylene) of 2 to 5:1.

* * * * *